US006257964B1

(12) United States Patent
Helgren

(10) Patent No.: US 6,257,964 B1
(45) Date of Patent: Jul. 10, 2001

(54) ROLL GRINDING SYSTEM FOR A ROLL

(75) Inventor: Dale E. Helgren, Green Bay, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/431,356

(22) Filed: Nov. 1, 1999

(51) Int. Cl.[7] ..... B24B 1/00

(52) U.S. Cl. ..... 451/49; 451/258; 451/366; 451/397; 451/424; 451/425; 451/426

(58) Field of Search ..... 451/49, 258, 366, 451/397, 424, 425, 426

(56) References Cited

U.S. PATENT DOCUMENTS 4,077,163 * 3/1978 Bennett, Jr. et al. ..... 451/123
5,117,081 * 5/1992 Bagdal ..... 219/69
5,853,318 * 12/1998 Thom et al. ..... 451/425

* cited by examiner

*Primary Examiner*—Joseph J. Hail, III
*Assistant Examiner*—Shantese McDonald
(74) *Attorney, Agent, or Firm*—Taylor & Aust, P.C.

(57) ABSTRACT

A roll grinding system includes a roll with a pair of longitudinally opposite ends, a longitudinal axis extending between the ends, and an outer surface. A material removal tool is movable in a travel path along a length of the roll. The material removal tool has a generally flat working surface oriented generally parallel to the travel path. A longitudinal displacement drive is connected with the material removal tool for moving the material removal tool along the travel path. A pair of supports are respectively positioned at and rotatably carry a corresponding end of the roll. At least one transverse displacement drive is provided, with each transverse displacement drive being connected with a corresponding support and configured to move the corresponding support in directions generally toward and away from the longitudinal axis. A controller is coupled with and controls operation of each transverse displacement drive, dependent upon a position of the material removal tool along the travel path whereby the outer surface of the roll is positioned substantially tangent to the working surface of the material removal tool.

21 Claims, 2 Drawing Sheets

ROLL GRINDING SYSTEM FOR A ROLL

BACKGROUND OF THE INVENTION

1. Field of the Invention

The present invention relates to a roll grinding system for grinding a roll used in a paper machine, and, more particularly, to a roll grinding system used to form a contoured surface on a roll for use in a paper machine.

2. Description of the Related Art

A number of different industrial processes utilize a plurality of rolls that carry a continuous sheet product. For example, a steel mill utilizes a plurality of rolls which transport the steel sheet from one end of the mill to another. A roll may be positioned adjacent to another roll and define a nip therebetween through which a metal sheet travels. A roll is typically made of steel and supported at opposite ends thereof with a bearing assembly. The length of the roll extends past the working width of the metal sheet. Because of weight considerations and the length of the roll, it is possible for the roll to sag somewhat in the middle. To achieve proper spacing between the rolls in the length direction of the roll and/or to achieve a constant nip pressure on the metal sheet across the length of the roll, it is known to provide a roll with a contoured shape to assist in maintaining a constant spacing and/or nip pressure across the length of the nip between two adjacent rolls.

A paper machine, such as a paper-making machine, typically also includes a plurality of rolls carrying wires, belts or felts (generically termed a "belt" herein), which in turn carry a fiber web from one end of the paper machine to the other end. The fiber web travels at a high rate of speed (e.g., 6000 feet/min) and it is necessary to ensure that the belts are longitudinally centered on the rolls as the fiber web moves through the machine.

One "steering" technique is to sense the lateral edge of a belt and adjust an end of the rotating roll in the paper machine during operation to shift the belt back to a longitudinally centered position. It is also known to provide a roll with a contoured shape to assist in maintaining the belt at a longitudinally centered position. For example, a roll may be formed with a crown such that the mid point along the length of the roll has a diameter which is larger than the ends of the roll.

A roll for use in a steel mill, paper machine or other application may be formed with a crown using a grinding wheel to form the contoured outer surface of the roll. A known technique is to position the grinding wheel along a travel path which is generally parallel with the longitudinal axis of the roll. By sequentially moving the grinding wheel at predefined increments along the travel path and adjusting the radial distance of the grinding face of the grinding wheel from the longitudinal axis of the roll, a crowned shape may be formed on the roll. A problem with such a technique is that a plurality of stepped shoulders are formed between adjacent grinding locations on the roll. By minimizing the travel direction in the longitudinal and radial directions between each grinding location, the stepped shoulders may be minimized but are still present. These stepped shoulders may in turn affect the quality of the manufactured sheet product.

Another known grinding technique is to utilize structure which rotates the grinding wheel about an axis which is perpendicular to the axis of rotation such that the grinding face of the grinding wheel is tangent to the area to be ground on the outer surface of the roll. Although this technique reduces the shoulders between adjacent grinds, the structure necessary to pivot the grinding wheel is relatively complex and expensive. Additionally, this technique requires that additional structure be added to the roll grinding system to allow the rotation of the grinding wheel about the pivot axis.

What is needed in the art is a roll grinding system and corresponding method of operation which allows a roll to be ground with a substantially continually smooth contoured surface, without the presence of stepped shoulders or the like.

SUMMARY OF THE INVENTION

The present invention provides a roll grinding system with a rotating grinding wheel having a generally flat grinding face which is movable along a length of the roll, and a pair of transverse displacement drives supporting opposite ends of the roll and movable in directions toward and away from the longitudinal axis of the roll. The transverse displacement drives are controllably actuated, dependent upon the longitudinal position of the grinding wheel along the length of the roll, such that the grinding face of the grinding wheel is always disposed substantially tangent to the roll in the contact area.

The invention comprises, in one form thereof, a roll grinding system including a roll with a pair of longitudinally opposite ends, a longitudinal axis extending between the ends, and an outer surface. A material removal tool is movable in a travel path along a length of the roll. The material removal tool has a generally flat working surface oriented generally parallel to the travel path. A longitudinal displacement drive is connected with the material removal tool for moving the material removal tool along the travel path. A pair of supports are respectively positioned at and rotatably carry a corresponding end of the roll. At least one transverse displacement drive is provided, with each transverse displacement drive being connected with a corresponding support and configured to move the corresponding support in directions generally toward and away from the longitudinal axis. A controller is coupled with and controls operation of each transverse displacement drive, dependent upon a position of the material removal tool along the travel path whereby the outer surface of the roll is positioned substantially tangent to the working surface of the material removal tool.

An advantage of the present invention is that the flat working surface of the material removal tool may be positioned substantially tangent to the contact area of the roll without utilizing a complex and expensive device for tilting the grinding wheel.

Another advantage is that conventional roll grinding systems typically already include a transverse displacement drive for moving at least one end of the roll in a radial direction. By utilizing proper control logic which interrelates the longitudinal position of the material removal tool with the transverse displacement position of the transverse displacement drive, existing equipment may be utilized with only a small amount of additional equipment and control logic.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
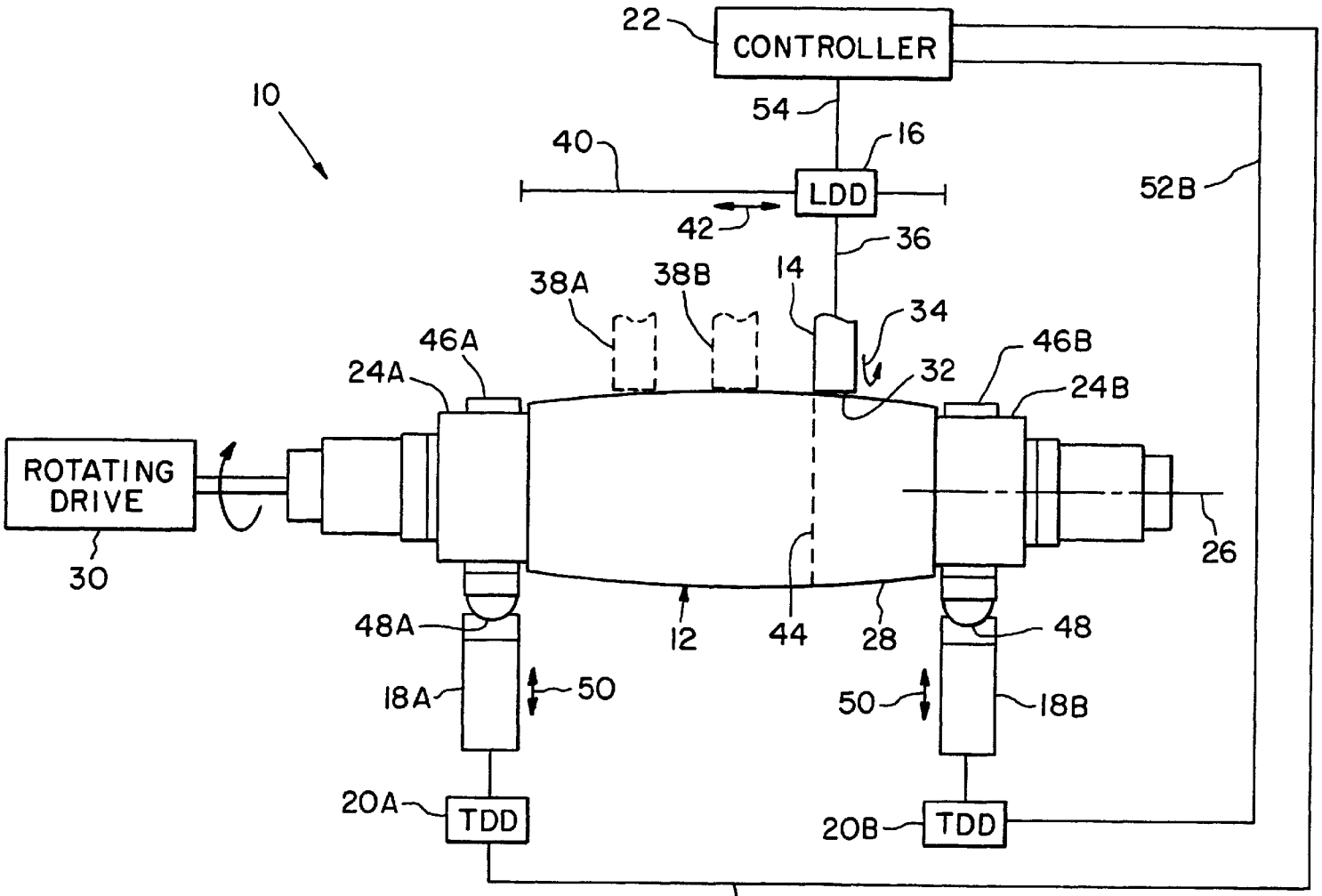
FIG. 1 is a schematic representation of an embodiment of a roll grinding system of the present invention for grinding a roll.

Referring now to the drawings and particularly to FIG. 1, there is shown an embodiment of a roll grinding system 10 of the present invention, which generally includes a roll 12, material removal tool 14, longitudinal displacement drive 16, supports 18A and 18B, transverse displacement drives 20A and 20B and controller 22.

Roll 12 includes a pair of longitudinally opposite ends 24A and 24B which are respectively rotatably carried by supports 18A and 18B. A longitudinal axis 26 extends between ends 24A and 24B. Roll 12 has a contoured (i.e., other than cylindrical) outer surface 28 which is configured for a specific application within a paper machine (not shown) in which roll 12 is to be utilized. In the embodiment shown, roll 12 has a crowned shape with a diameter midway between ends 24A and 24B which is larger than a diameter adjacent ends 24A and 24B. It is to be understood, however, that roll 12 may have other contoured shapes suitable for a specific application. Additionally, in the embodiment shown, roll 12 is constructed from metal. However, it is also to be understood that roll 12 may be constructed from another material such as granite, etc. When used in a paper machine, roll 12 may have a length up to approximately 10 meters. Thus, it is apparent that dependent upon the type of material from which roll 12 is constructed, roll 12 is likely very heavy (e.g., 5–20 tons) and has a substantial momentum when rotatably driven at a selected speed by rotating drive 30.

Material removal tool 14 includes a flat working surface 32 which is used to form contoured outer surface 28 of roll 12. In the embodiment shown, material removal tool 14 is in the form of a grinding wheel and flat working surface 32 is in the form of a grinding face. Grinding wheel 14 rotates at a rotational speed in known manner. In the embodiment shown, grinding wheel 14 is assumed to rotate in the direction indicated by arrow 34.

Grinding wheel 14 is movable along a length of roll 12 between ends 24A and 24B. Longitudinal displacement drive 16 is connected with grinding wheel 14 (as indicated schematically by line 36) and moves grinding wheel 14 to any of a plurality of selected positions between ends 24A and 24B, as indicated in phantom lines at alternate positions 38A and 38B of grinding wheel 14. Longitudinal displacement drive 16 may be in the form of, e.g., a chain ft drive, pneumatic or hydraulic drive, etc. which is capable of moving grinding wheel 14 to a i selected position along a travel path 40 in opposite directions between ends 24A and 24B, as indicated by double beaded arrow 42. In the embodiment shown, travel path 40 is a linear travel path; however, travel path 40 may be configured as a curved travel path if desired.

When roll 12 is at a neutral position as shown in FIG. 1, grinding face 32 of grinding wheel 14 is positioned generally parallel with longitudinal axis 26 of roll 12. Thus, it is evident that grinding face 32 is positioned at an angle relative to outer surface 28 of roll 12 such that a leading edge 32A of grinding face 32 contacts outer surface 28 while a trailing edge 32B of grinding face 32 is positioned at a distance away from outer surface 28. If grinding wheel 14 is used in the position as shown in FIG. 1 to form outer surface 28 of roll 12, a tangent line 44 at leading edge 32A is formed in outer surface 28 of roll 12.

Supports 18A and 18B are respectively positioned at and rotatably carry ends 24A and 24B of roll 12. More particularly, supports 18A and 18B each include a roller bearing 46A and 46B for respectively carrying ends 24A and 24B. Each support 18A and 18B is coupled with a transverse displacement device 20A and 20B, respectively, and is movable in radial directions toward and away from longitudinal axis 26 of roll 12, as indicated by arrow 50. Each transverse displacement drive 20A and 20B may be suitably configured to move the corresponding support 18A and 18B in transverse displacement directions 50. For example, each transverse displacement device 20A and 20B may be configured as a hydraulic or pneumatic drive, a rotatable screw drive, etc. Each support 18A and 18B also includes a spherical support bearings 48A and 48B which accommodates angular misalignment between roll 12 and supports 18A and 18B as supports 18A and 18B are displaced in radial directions 50. That is, each spherical support bearing 48A and 48B allows the corresponding roller bearing 46A and 46B to be positioned generally concentric and parallel with longitudinal axis 26 of roll 12.

Controller 22 is coupled with transverse displacement drives 20A and 20B via electric lines 52A and 52B, respectively, and controls operation of each transverse displacement drive 20A and 20B, dependent upon a position of grinding wheel 14 along travel path 40. More particularly, controller 22 is connected with longitudinal displacement drive 16 associated with grinding wheel 14 via electrical line 54 and controls operation of longitudinal displacement drive 16 to in turn move grinding wheel 14 to a selected position along travel path 40. The position of longitudinal displacement drive 16 along travel path 40 may be determined using any of a number of known techniques, such as a sensor position, the number of steps of a stepper motor, the duration of activation of longitudinal displacement drive 16 from a known reference, etc. Dependent upon the calculated, sensed or determined position of longitudinal displacement drive 16 and grinding wheel 14, controller 22 activates transverse displacement drive 20A and/or 20B to tilt roll 12 such that outer surface 28 is positioned generally tangent with grinding face 32 in an area of contact therebetween.

Figure 2:
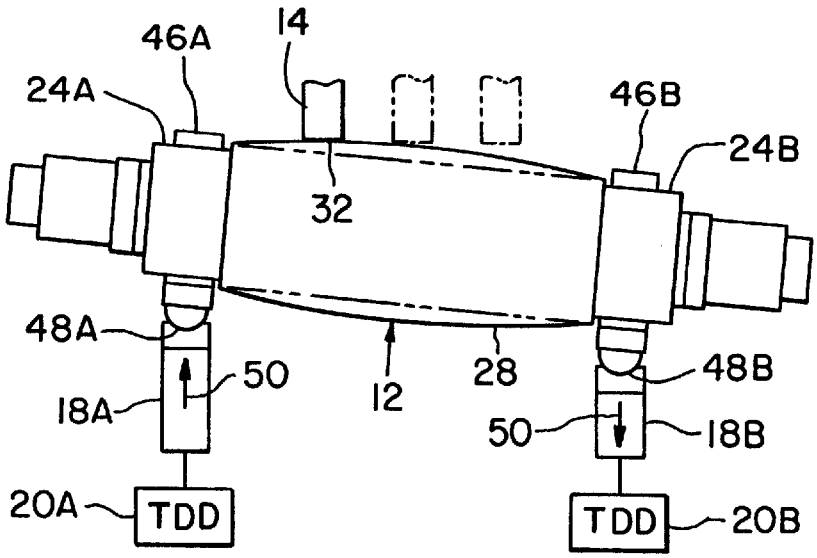
FIG. 2 is a plan view illustrating the grinding wheel of FIG. 1 in a first position and the roll tilted to a position tangent to the grinding face of the grinding wheel.

Referring to FIG. 2, grinding wheel 14 is shown moved to a position closer to end 24A of roll 12. Controller 22 thus actuates transverse displacement drives 20A and 20B such that supports 18A and 18B are moved in the directions shown by arrows 50. Outer surface 28 of roll 12 is thus positioned generally tangent to grinding face 32 of grinding wheel 14 when grinding wheel 14 is in the position shown.

Figure 3:
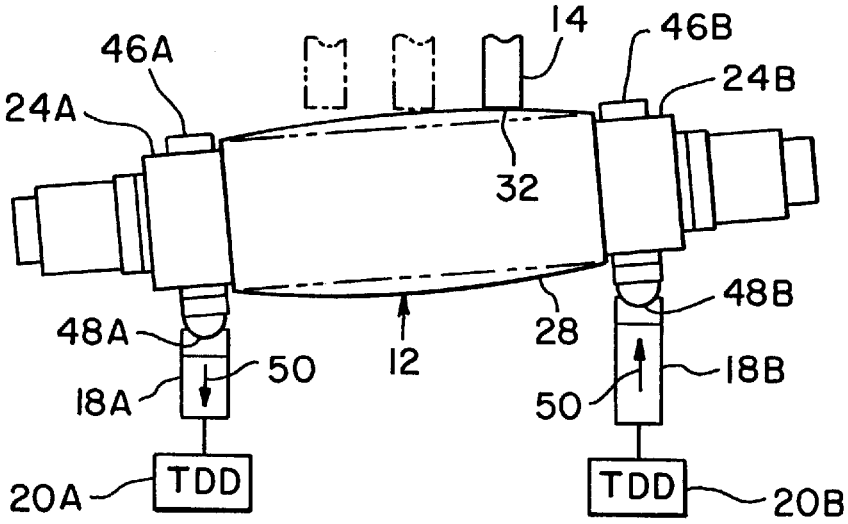
FIG. 3 is a plan view illustrating the grinding wheel of FIG. 1 in another position and the toll tilted to another position tangent to the grinding face of the grinding wheel.

FIG. 3 illustrates grinding wheel 14 moved to the position shown in FIG. 1 toward the right hand side of roll 12 adjacent end 24B. Controller 22 activates transverse displacement drive 20A and 20B to move supports 18A and 18B in the directions indicated by arrows 50. Thus, outer surface 28 of roll 12 is disposed substantially tangent to grinding face 32 of grinding wheel 14. It will be appreciated that in addition to the positions of grinding wheel 14 shown in FIGS. 2 and 3, controller 22 may activate longitudinal displacement drive 16 to move grinding wheel 14 to any selected position along a length of roll 12 between ends 24A and 24B. Dependent upon the predetermined curvature of outer surface 38 and the position of grinding wheel 14, the angular orientation of longitudinal axis 26 is determined by controller 22 (using, e.g., a mathematical function, on line slope calculation of the curve at the point of cut, etc.) so that transverse displacement drives 20A and 20B may be actuated accordingly to position outer surface 28 generally tangent to grinding face 32. Alternatively, controller 22 may include a memory with a stored look-up table which correlates the position of longitudinal displacement drive 16 with the angular orientation of roll 12 to position outer surface 28 tangent to grinding face 32.

In the embodiment shown in the drawings, controller 22 controls operation of longitudinal displacement drive 16 via electrical line 54. However, it is also possible to move longitudinal displacement drive 16 independently from controller 22. For example, longitudinal displacement drive 16 may be moved along the length of roll 12 between ends 24A and 24B at known displacement increments and time intervals. Controller 22 may utilize the start time and time intervals between moves to infer the position of longitudinal displacement drive 16. Alternatively, longitudinal displacement drive 16 may be independently controlled or moved and provide an output signal over electrical line 54 which is received by controller 22 so that controller 22 may easily determine the position of longitudinal displacement drive 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A roll grinding system, comprising:

a roll with a pair of longitudinally opposite ends, a longitudinal axis extending between said ends, and an outer surface;

a material removal tool movable in a travel path along a length of said roll, said material removal tool having a generally flat working surface oriented generally parallel to said travel path;

a longitudinal displacement drive connected with said material removal tool for moving said material removal tool along said travel path;

a pair of supports, each said support positioned at and rotatably carrying a corresponding end of said roll;

at least one transverse displacement drive, each said transverse displacement drive connected with a corresponding support and configured to move said corresponding support in directions generally toward and away from said travel path; and a controller coupled with and controlling operation of each said transverse displacement drive, dependent upon a position of said material removal tool along said travel path.

2. The roll grinding system of claim l, wherein said controller controls operation of each said transverse displacement drive to position said outer surface of said roll substantially tangent to said working surface of said material removal tool.

3. The roll grinding system of claim 1, wherein said controller is further coupled with said longitudinal displacement drive to determine said position of said material removal tool along said travel path.

4. The roll grinding system of claim 3, wherein said controller controls operation of said longitudinal displacement drive.

5. The roll grinding system of claim 3, wherein said longitudinal displacement drive provides an output signal to said controller indicative of said position of said material removal tool along said travel path.

6. The roll grinding system of claim 1, wherein said material removal tool comprises a grinding wheel and said working surface comprises a grinding face.

7. The roll grinding system of claim 1, wherein said travel path of said material removal tool is substantially linear.

8. The roll grinding system of claim 1, further comprising a rotating drive coupled with said roll for rotatably driving said roll.

9. The roll grinding system of claim 1, wherein each said support includes a spherical support bearing accommodating angular misalignment between said support and said roll.

10. A roll grinding system for grinding a roll used to carry a continuous sheet, the roll including a pair of longitudinally opposite ends, a longitudinal axis extending between the ends, and an outer surface, said roll grinding system comprising:

a material removal tool movable in a travel path along a length of the roll, said material removal tool having a generally flat working surface oriented generally parallel to said travel path;

a longitudinal displacement drive connected with said material removal tool for moving said material removal tool along said travel path;

a pair of supports, each said support configured to rotatably carrying a corresponding end of the roll;

at least one transverse displacement drive, each said transverse displacement drive connected with a corresponding support and configured to move said corresponding support in directions generally toward and away from said travel path; and a controller coupled with and controlling operation of each said transverse displacement drive, dependent upon a position of said material removal tool along said travel path.

11. The roll grinding system of claim 10, wherein said controller controls operation of each said transverse displacement drive to position the outer surface of the roll substantially tangent to said working surface of said material removal tool.

12. The roll grinding system of claim 10, wherein said controller is further coupled with said longitudinal displacement drive to determine said position of said material removal tool along said travel path.

13. The roll grinding system of claim 12, wherein said controller controls operation of said longitudinal displacement drive.

14. The roll grinding system of claim 12, wherein said longitudinal displacement drive provides an output signal to said controller indicative of said position of said material removal tool along said travel path.

15. The roll grinding system of claim 10, wherein said material removal tool comprises a grinding wheel and said working surface comprises a grinding face.

16. The roll grinding system of claim 10, wherein said travel path of said material removal tool is substantially linear.

17. The roll grinding system of claim 10, wherein each said support includes a spherical support bearing accommodating angular misalignment between said support and said roll.

18. A method of forming an outer surface on a roll, comprising the steps of:

providing a roll with a pair of longitudinally opposite ends, a longitudinal axis extending between said ends, and an outer surface;

positioning a material removal tool adjacent said outer surface of said roll at a position in a travel path along a length of said roll, said material removal tool having a generally flat working surface oriented generally parallel to said travel path;

supporting and rotatably carrying each said end of said roll with a corresponding support;

connecting at least one said support with a corresponding transverse displacement drive;

coupling a controller with each said transverse displacement drive; and controllably actuating at least one said transverse displacement drive with said controller to move said transverse displacement drive in a direction generally toward or away from said travel path, dependent upon said position of said material removal tool along said travel path.

19. The method of claim 18, wherein said controllably actuating step comprises controllably actuating each said transverse displacement drive.

20. The method of claim 18, comprising the further step of moving said material removal tool along said travel path.

21. A method of forming an outer surface on a roll, comprising the steps of:

providing a roll with a pair of longitudinally opposite ends, a longitudinal axis extending between said ends, and an outer surface;

positioning a material removal tool adjacent said outer surface of said roll at a position in a travel path along a length of said roll, said material removal tool having a generally flat working surface oriented generally parallel to said travel path;

supporting and rotatably carrying each said end of said roll with a corresponding support;

connecting at least one said support with a corresponding transverse displacement drive; and actuating at least one said transverse displacement drive to move said transverse displacement drive in a direction generally toward or away from said travel path, dependent upon said position of said material removal tool along said travel path.

* * * * *